US007182797B2

(12) United States Patent
Mekonen

(10) Patent No.: US 7,182,797 B2
(45) Date of Patent: Feb. 27, 2007

(54) FUEL COMPOSITIONS

(76) Inventor: Kenneth Mekonen, 16 Norwalk Ave., Staten Island, NY (US) 10314-5622

( * ) Notice: Subject to any disclaimer, the term of this patent is extended or adjusted under 35 U.S.C. 154(b) by 0 days.

(21) Appl. No.: 10/983,992

(22) Filed: Nov. 8, 2004

(65) Prior Publication Data

US 2006/0096160 A1 May 11, 2006

(51) Int. Cl.
*C10L 1/18* (2006.01)
*C10L 1/22* (2006.01)

(52) U.S. Cl. ..... 44/389; 44/412; 44/443; 44/445; 44/301; 44/302; 510/535; 516/20; 516/21; 516/28; 516/29; 516/30; 516/53; 516/72; 516/73; 516/74

(58) Field of Classification Search ..... 44/388, 44/389, 412, 443, 445, 301, 302; 570/535; 516/20, 21, 28, 29, 30, 53, 72, 73, 74
See application file for complete search history.

(56) References Cited

U.S. PATENT DOCUMENTS 4,477,258 A * 10/1984 Lepain ..... 44/302
4,877,414 A * 10/1989 Mekonen ..... 44/301
6,235,067 B1 * 5/2001 Ahern et al. ..... 44/301
2004/0111955 A1 * 6/2004 Mullay et al. ..... 44/301

FOREIGN PATENT DOCUMENTS

| | | | |
|---|---|---|---|
| CN | 1473912 | * | 2/2004 |
| DE | 1900531 | * | 12/1969 |
| GB | 2066288 | * | 7/1981 |
| WO | WO9318117 | * | 9/1993 |

* cited by examiner

*Primary Examiner*—Cephia D. Toomer
(74) *Attorney, Agent, or Firm*—Hovey Williams LLP

(57) ABSTRACT

Improved fuel compositions and fuel additive packages are disclosed which serve to increase the combustion efficiency of conventional fuels while reducing the level of $CO_2$ emissions generated upon the combustion of the fuels. The fuels may be essentially water-free hydrocarbon fuels such as gasoline or diesel fuel, or may be in the form of hydrosols. The additive packages of the invention include sorbitan oleate, a polyoxyethylene alcohol, an alkylene glycol, and an amine.

33 Claims, No Drawings

FUEL COMPOSITIONS

BACKGROUND OF THE INVENTION

1. Field of the Invention

The present invention is broadly concerned with improved fuel compositions and additive packages therefor, which are capable of increasing the fuel efficiency while also significantly reducing the level of $CO_2$ emissions generated upon combustion of the fuels. The fuels may be traditional hydrocarbon fuels or hydrosols, and include an additive package having a sorbitan oleate, a polyoxyethylene alcohol, an alkylene glycol, and an amine.

2. Description of the Prior Art

A large number of additives have been proposed in the past for use with conventional hydrocarbon fuels such as gasoline, diesel fuel, or fuel oils. In many cases additives have been proposed to remedy specific problems, such as elimination of knocking to the addition of tetraethyl lead gasoline. Other agents have also been proposed for enhancing combustion efficiency, and hence the work output derived per unit of fuel consumed.

Researchers in the art have also proposed that significant quantities of water could be added to liquid hydrocarbon fuels to form a combustible emulsions or hydrosols, which would, theoretically, lessen the consumption of the expensive hydrocarbon fuel. Indeed, such proposals extend back to the late nineteenth century. The numerous problems heretofore experienced with such emulsified fuels include the fact that, when relatively large quantities of water are present, the combustion temperature is lowered; moreover, the presence of substantial water lowers the overall caloric value of the fuel. Finally, many prior fuel/water emulsions are relatively unstable, and tend to separate over time. Of course, if large quantities of surfactants are employed in such emulsions, the problem of phase separation can be avoided; however, this is inherently a very expensive proposition, and therefore in order to be truly economical, the amount of surfactant employed in an emulsified fuel must be relatively small.

PCT Publication No. WO 86/00333 describes improved hydrosols made up of a hydrocarbon fuel, water, a stabilizing surfactant and up to about 2.5% by weight of a polyolefin. This is asserted to increase the combustion efficiency and octane rating of the fuels.

U.S. Pat. No. 4,877,414 to Mekonen describes fuel compositions in the form of tradition hydrocarbon fuels or hydrosols which include the addition of alpha olefins and alkyl benzenes. Similarly, U.S. Pat. No. 5,372,613 to Mekonen discloses fuel compositions which are improved by the addition of an organic titanate.

These prior art references are primarily concerned with increasing combustion efficiencies of the fuels. However, in recent times the issue of greenhouse gas emissions, and particularly $CO_2$, has become a matter of environmental concern. Therefore, there is a need in the art for improved fuel compositions having the twin characteristics of enhanced combustion efficiency and, at the same time, reduced $CO_2$ emissions.

SUMMARY OF THE INVENTION

The present invention overcomes the problems outlined above and provides improved fuel compositions and additive packages to be used with fuels, which significantly reduce $CO_2$ emissions generated upon combustion of the fuels. Broadly speaking, the base fuels of the invention may be essentially water-free hydrocarbon fuels such as gasoline, diesel fuel or heavy fuel oil, or alternately hydrosols made up of such hydrocarbon fuels with added water. In any case, the additive package used with such base fuels includes respective quantities of a sorbitan oleate, a polyoxyethylene alcohol, an alkylene glycol, and an amine.

It is believed that the presence of the amine (which may be a primary, secondary, or tertiary amine or amine derivative) is instrumental in reducing $CO_2$ emissions incident to combustion of the fuels. Specifically, it is theorized that the amine reacts catalytically with hydrogen in the fuel (which may be derived from the glycol component) to produce ammonia; the ammonia then reacts with $CO_2$ to yield ammonium carbamate. The carbamate in turn is dehydrated by the heat of combustion to give urea and water.

In preferred forms, the additive package includes quantities of sorbitan monooleate and sorbitan sesquioleate as the total oleate fraction. Similarly, the POE alcohol is advantageously present as POE(3) tridecyl alcohol and POE(6) tridecyl alcohol. Various other optional ingredients may also be used in the additive packages, especially toluene, xylene, VMP naptha (in the case of water-free fuels), and alkyl benzene.

DETAILED DESCRIPTION OF THE PREFERRED EMBODIMENT

As noted above, the fuel compositions of the invention broadly include a combustible hydrocarbon-based fuel and an additive package mixed with the fuel. The fuels may be traditional, essentially water fuels, such as gasolines, diesel fuels or heavy fuel oils, or may alternately be hydrosols containing a substantial fraction of water with a hydrocarbon fuel. In all instances, the additive package is present in relatively small amounts, normally on the order of from about 0.16–0.64 fluid ounces of additive package/gallon of hydrocarbon-based fuels. In the case of gasolines, the additive package is normally present at a level from about 0.16–0.48 fluid ounces/gallon of gasoline; with diesel fuels, a slightly greater amount is normally used, typically 0.32–0.64 fluid ounces/gallon of diesel fuel. It will be appreciated, however, that the amount of additive package used is based upon the exact makeup of the package, the desired fuel performance, and cost of the additive package.

The preferred additive packages of the invention have slightly different makeups when used with essentially water-free fuels, versus hydrosols. In all instances though, the additive packages include respective quantities of a sorbitan oleate, a polyoxyethylene alcohol, an alkylene glycol, and an amine.

The sorbitan oleate component is preferably made up of individual quantities of sorbitan monooleate and soribtan sesquioleat, with the total sorbitan oleate fraction being used at levels set forth in the following Tables. The oleates are useful as coupling and dispersing agents in the improved fuels of the invention.

The polyoxyethylene alcohol component can be variable, but in most preferred cases it comprises a combination of 3 and 6 molar ethoxylates of a C6–C22 alcohol (e.g., tridecyl alcohol), i.e., POE(3) and POE(6) alcohols. The overall alcohol content of the fuels, and the preferred contents of the POE(3) and POE(6) are set forth below.

The additive packages also contain an alkylene glycol, which serve as a source of hydrogen radicals. Preferably, the glycols are C2–C8 glycols, most preferably hexylene glycol.

The amine component of the additive packages can be in the form of a primary, secondary (e.g., ethoxylated fatty acid amines), or tertiary amine or amine derivative. For reasons of cost, the primary amines are preferred, these having the formula R—$NH_2$, where R is selected from the group consisting of C1–C18 straight or branched chain alkyl, alkenyl, and alkynyl groups, aryl groups, and organic heteroatom groups containing an O, S or N ion. Most preferably though, the primary means are selected from the group consisting of C1–C12 alkyl amines. More specifically, the following alkylamines are particularly useful: isopropylamine, CAS #75-31-0, ethylamine, CAS #75-04-7, diethylamine, CAS # 109-89-7, and triethylaimne, CAS # 121-44-8. Alkanolamines are also useful, e.g., monoethanolamine, CAS # 141-43-5, diethanolamine, CAS #111-42-2, triethanolamine, CAS #102-71-6.

The following Table 1 sets forth additional operative amines useful in the invention.

| Product Name | CAS number | CAS Name | Alternative CAS Number | CAS Name |
|---|---|---|---|---|
| E-14-2 | 68478-95-5 | Poly(oxy-1,2-ethanediyl),a,a[1]-(iminodi-2,1-ethanediyl)bis]w-hydroxy-,N-[3-(branched decyloxy)propyl] derivs. | 218141-23-2 | Poly(oxy-1,2-ethanediyl),a,a[1]-(limiodi-2,1-ethanediyl)bis[w-hydroxy-,N-[2-(C9-11-isoalkyloxy)propyl] derivs., C10 rich |
| E-14-5 | 68478-95-5 | Poly(oxy-1,2-ethanediyl),a,a[1]-(iminodi-2,1-ethanediyl)bis]w-hydroxy-,N-[3-(branched decyloxy)propyl] derivs. | 218141-23-2 | Poly(oxy-1,2-ethanediyl),a,a[1]-(limiodi-2,1-ethanediyl)bis[w-hydroxy-,N-[2-(C9-11-isoalkyloxy)propyl] derivs., C10 rich |
| E-17-2 | 68478-96-5 | Poly(oxy-1,2-ethanediyl),a,a[1]-(iminodi-2,1-ethanediyl)bis]w-hydroxy-,N-[3-(branched tridecyloxy)propyl] derivs. | 223129-76-8 | Poly(oxy-1,2-ethanediyl),a,a[1]-(limiodi-2,1-ethanediyl)bis[w-hydroxy-,N-[2-(C13-rich, 11–14 isoalkyl)oxy]propyl] derivs. |
| E-17-5 | 68478-96-6 | Poly(oxy-1,2-ethanediyl),a,a[1]-(iminodi-2,1-ethanediyl)bis]w-hydroxy-,N-[3-(branched tridecyloxy)propyl] derivs. | 223129-76-8 | Poly(oxy-1,2-ethanediyl),a,a[1]-(limiodi-2,1-ethanediyl)bis[w-hydroxy-,N-[2-(C13-rich, 11–14 isoalkyl)oxy]propyl] derivs. |
| E-S-15 | 61791-24-0 | Amines, soya alkyl, ethoxylated | | |
| E-S-2 | 61791-24-0 | Amines, soya alkyl, ethoxylated | | |
| E-S-3.5 | 61791-24-0 | Amines, soya alkyl, ethoxylated | | |
| E-S-5 | 61791-24-0 | Amines, soya alkyl, ethoxylated | | |

The additive packages may also have a number of optional ingredients, such as individual quantities of toluene and xylene, the latter normally being in equal quantities. Where an essentially water-free fuel is being supplemented, the additive package may also include VMP naptha. Other optional ingredients may include alkyl benzene, and an alpha olefin (e.g., decene-1). The alkyl benzene aids in the lubricity of the fuels and cleavage of hydrocarbon molecules. The alpha olefin increases the power factor of the complete fuels.

The following tables 2–5 set forth ranges of use for the components of water-free and hydrosol fuels in accordance with the invention, as well as additive packages for incorporation into water-free fuels and hydrosols; the tables include information respecting generic components as well as preferred components. In Tables 2 and 3 relating to complete fuels, the ranges are expressed as percentages by weight, based upon the total weight of the fuels taken as 100% by weight. In Tables 4 and 5 relating to the additives per se, the ranges are expressed as percentages by weight, based upon the total weight of the additive packages taken as 100% by weight.

TABLE 2

WATER-FREE FUELS

| FUEL CONSTITUENT | CAS NO. | BROAD RANGE | PREFERRED |
|---|---|---|---|
| Hydrocarbon-based fuel | n/a | 67.50–97.90% | 84.50% |
| Total additive package | n/a | 2.10–12.50% | 15.50% |
| Total sorbitan oleate | n/a | 1.80–6.00% | 3.75% |
| a. Sorbitan monooleate | 1338-43-8 | 0.90–2.50% | 1.25% |
| b. Sorbitan sesquioleate | 8007-43-0 | 0.90–3.50% | 2.50% |
| Total POE alcohol | n/a | 3.00–8.00% | 5.00% |
| a. POE(3) tridecyl alcohol | 78330-21-9 | 2.00–5.00% | 1.66% |
| b. POE(6) tridecyl alcohol | 78330-21-9 | 1.00–3.00% | 3.34% |
| Alkylene glycol | n/a | 0.25–0.75% | 0.30% |
| Amine | n/a | 0.05–5.00% | 3.00% |

TABLE 2-continued

WATER-FREE FUELS

| FUEL CONSTITUENT | CAS NO. | BROAD RANGE | PREFERRED |
|---|---|---|---|
| Toluene | 108-88-3 | 0.05–5.00% | 0.75% |
| Xylene | 1330-20-7 | 0.05–5.00% | 0.75% |
| VMP naptha | 68410-97-9 | 0.50–10.00% | 1.50% |
| Alkyl benzene | 68855-24-3 | 0.05–5.00% | 0.50% |

TABLE 3

HYDROSOLS

| FUEL CONSTITUENT | CAS NO. | BROAD RANGE | PREFERRED |
|---|---|---|---|
| Hydrocarbon-based fuel | n/a | 67.80–93.40% | 75.50% |
| Water | n/a | 5.00–25.00% | 20.00% |
| Total additive package | n/a | 0.75–6.00% | 4.50% |

TABLE 3-continued

HYDROSOLS

| FUEL CONSTITUENT | CAS NO. | BROAD RANGE | PREFERRED |
|---|---|---|---|
| Total sorbitan oleate | n/a | 0.45–3.00% | 0.90% |
| a. Sorbitan monooleate | 1338-43-8 | 0.30–2.0% | 0.60% |
| b. Sorbitan sesquioleate | 8007-43-0 | 0.15–1.00% | 0.30% |
| Total POE alcohol | n/a | 0.15–0.60% | 0.60% |
| a. POE(3) tridecyl alcohol | 78330-21-9 | 0.10–0.40% | 0.40% |
| b. POE(6) tridecyl alcohol | 78330-21-9 | 005–0.20% | 0.20% |
| Alkylene glycol | n/a | 0.10–0.30% | 0.20% |
| Amine | n/a | 0.05–0.50% | 0.40% |
| Toluene | 108-88-3 | 0.10–0.50% | 0.35% |
| Xylene | 1330-20-7 | 0.10–0.50% | 0.35% |
| Alkyl benzene | 68855-24-3 | 0.10–0.40% | 0.20% |

TABLE 4

ADDITIVE PACKAGES FOR WATER-FREE FUELS

| ADDITIVE PACKAGE CONSTITUENT | CAS NO. | BROAD RANGE | PREFERRED |
|---|---|---|---|
| Total sorbitan oleate | n/a | 0.45–3.00% | 1.50% |
| a. Sorbitan monooleate | 1338-43-8 | 0.15–1.00% | 0.50% |
| b. Sorbitan sesquioleate | 8007-43-0 | 0.30–2.00% | 1.00% |
| Total POE alcohol | n/a | 0.10–3.00% | 1.50% |
| a. POE(3) tridecyl alcohol | 78330-21-9 | 0.05–2.00% | 1.00% |
| b. POE(6) tridecyl alcohol | 78330-21-9 | 0.05–1.00% | 0.50% |
| Alkylene glycol | n/a | 0.05–1.00% | 0.50% |
| Amine | n/a | 0.05–5.00% | 3.00% |
| Toluene | 108-88-3 | 0.05–5.00% | 1.50% |
| Xylene | 1330-20-7 | 0.05–5.00% | 1.50% |
| VMP naptha | 68410-97-9 | 67.80–95.00% | 90.00% |
| Alkyl benzene | 68855-24-3 | 0.50–1.00% | 0.50% |

TABLE 5

ADDITIVE PACKAGES FOR HYDROSOLS

| ADDITIVE PACKAGE CONSTITUENT | CAS NO. | BROAD RANGE | PREFERRED |
|---|---|---|---|
| Total sorbitan oleate | n/a | 4.00–25.00% | 18.00% |
| a. Sorbitan monooleate | 1338-43-8 | 1.00–10.00% | 6.00% |
| b. Sorbitan sesquioleate | 8007-43-0 | 3.00–15.00% | 12.00% |
| Total POE alcohol | n/a | 1.50–15.00% | 9.00% |
| a. POE(3) tridecyl alcohol | 78330-21-9 | 1.00–10.00% | 6.00% |
| b. POE(6) tridecyl alcohol | 78330-21-9 | 0.50–5.00% | 3.00% |
| Alkylene glycol | n/a | 0.50–3.00% | 2.00% |
| Amine | n/a | 1.00–10.00% | 5.00% |
| Toluene | 108-88-3 | 5.00–40.00% | 32.50% |
| Xylene | 1330-20-7 | 5.00–40.00% | 32.50% |
| Alkyl benzene | 68855-24-3 | 0.05–2.00% | 1.00% |

Although not wishing to be bound by any theory, it is believed that the presence of the amine in the additive packages and improved fuels of the invention aids in decreasing $CO_2$ emissions upon combustion of the fuels. That is, the amine reacts catalytically with hydrogen present in the fuel mixture by virtue of the glycol fraction to generate ammonia. The ammonia then reacts with $CO_2$ to form ammonium carbamate, which is in turn dehydrated during combustion to yield urea and water. These reactions are exemplified by the following, where use is made of a primary amine:

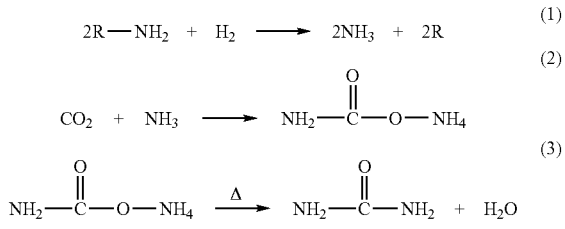

As can be seen, this reaction scheme is both simple and environmentally benign, yielding only water and urea as end products. However, significant quantities of $CO_2$ are taken up, resulting in lessened emissions thereof. The fuels of the invention should exhibit at least about a 15% reduction in $CO_2$ emissions, as compared with present-day conventional fuels.

I claim:

1. A fuel composition comprising a combustible hydrocarbon-based fuel and an additive package mixed with said fuel, said additive package being present at a level for reducing the amount of $CO_2$ emissions generated upon combustion of the fuel composition, as compared with an otherwise identical fuel composition in the absence of said additive package, said additive package including respective quantities of a sorbitan oleate, a polyoxyethylene alcohol, an alkylene glycol, and an amine.

2. The fuel composition of claim 1, said hydrocarbon-based fuel selected from a group consisting of gasolines, diesel fuels and heavy fuel oils.

3. The fuel composition of claim 1, said hydrocarbon-based fuel being a hydrosol and comprising a hydrocarbon fuel and an amount of water.

4. The fuel composition of claim 3, said hydrosol containing from about 5–25% by weight water, based upon the total weight of the fuel composition taken as 100% by weight.

5. The fuel composition of claim 1, including individual quantities of sorbitan monooleate and soribtan sesquioleate.

6. The fuel composition of claim 1, said fuel composition being essentially water-free, said sorbitan oleate being present at a level of from about 1.8–5.00% by weight, based upon the total weight of the fuel composition taken as 100% by weight.

7. The fuel composition of claim 1, said polyoxyethylene alcohol comprising POE (6) tridecyl alcohol.

8. The fuel composition of claim 7, said fuel composition being essentially water-free, said polyoxyethylene alcohol being present at a level of from about 3.00–8.00% by weight, based upon the total weight of the fuel composition taken as 100% by weight.

9. The fuel composition of claim 1, said alkylene glycol comprising hexylene glycol.

10. The fuel composition of claim 1, said fuel composition being essentially water-free, said alkylene glycol being present at a level of from about 0.25–0.75% by weight, based upon the total weight of the fuel composition taken as 100% by weight.

11. The fuel composition of claim 1, said amine being a primary amine having the formula R—$NH_2$, where R is selected from the group consisting of C1–C18 straight or branched chain alkyl, alkenyl, and alkynyl groups, aryl groups, and organic heteroatom groups containing an O, S or N.

12. The fuel composition of claim 11, said amine selected from the group consisting of C1–C12 alkyl amines.

13. The fuel composition of claim 1, said fuel composition being essentially water-free, said amine being present at a level of from about 0.05–5.00% by weight, based upon the total weight of the fuel composition taken as 100% by weight.

14. The fuel composition of claim 1, said additive package further including individual quantities of toluene and xylene.

15. The fuel composition of claim 14, said additive package including equal quantities of toluene and xylene.

16. The fuel composition of claim 14, said fuel composition being essentially water-free, said quantities of toluene and xylene together totaling from about 0.10–10.00% by weight, based upon the total weight of the fuel composition taken as 100% by weight.

17. The fuel composition of claim 1, said fuel composition being essentially water-free, said additive package including naptha present at a level of from about 0.5–10.00% by weight, based upon the total weight of the fuel composition taken as 100% by weight.

18. The fuel composition of claim 1, said additive package being present at a level of from about 0.16–0.64 fluid ounces/gallon of hydrocarbon-based fuel.

19. The fuel composition of claim 18, said fuel being a gasoline, said additive package being present at a level of from about 0.16–0.48 fluid ounces/gallon of gasoline.

20. The fuel composition of claim 18, said fuel being diesel fuel, said additive package being present at a level of from about 0.32–0.64 fluid ounces/gallon of diesel fuel.

21. The fuel composition of claim 1, said fuel composition being a hydrosol, said sorbitan oleate being present at a level of from about 0.45–3.00% by weight, based upon the total weight of the fuel composition taken as 100% by weight.

22. The fuel composition of claim 1, said fuel composition being a hydrosol, said polyoxyethylene alcohol being present at a level of from about 0.15–0.60% by weight, based upon the total weight of the fuel composition taken as 100% by weight.

23. The fuel composition of claim 1, said fuel composition being a hydrosol, said alkylene glycol being present at a level of from about 0.10–0.30% by weight, based upon the total weight of the fuel composition taken as 100% by weight.

24. The fuel composition of claim 1, said fuel composition being a hydrosol, said amine being present at a level of from about 0.05–0.50% by weight, based upon the total weight of the fuel composition taken as 100% by weight.

25. The fuel composition of claim 14, said fuel composition being a hydrosol, said quantities of toluene and xylene together totaling from about 0.20–1.00% by weight, based upon the total weight of the fuel composition taken as 100% by weight.

26. An additive package for mixing with a hydrocarbon-based fuel and operable to reduce CO2 emissions generated upon combustion of the fuel, said additive package including respective quantities of a sorbitan oleate, of a polyoxyethylene alcohol, an alkylene glycol, and an amine.

27. The additive package of claim 26, including individual quantities of sorbitan monooleate and sorbitan sesquioleate.

28. The additive package of claim 26, said polyoxyethylene alcohol comprising POE (6) tridecyl alcohol.

29. The additive package of claim 26, said alkylene glycol comprising hexylene glycol.

30. The additive package of claim 26, said amine being a primary amine having the formula R—$NH_2$, where R is selected from the group consisting of C1–C18 straight or branched chain alkyl, alkenyl, and alkynyl groups, aryl groups, and organic heteroatom groups containing an O, S or N.

31. The additive package of claim 30, said amine selected from the group consisting of C1–C12 alkyl amines.

32. The additive package of claim 26, said additive package further including individual quantities of toluene and xylene.

33. The additive package of claim 32, said additive package including equal quantities of toluene and xylene.

* * * * *